US008180684B1

(12) United States Patent
Wittsche

(10) Patent No.: US 8,180,684 B1
(45) Date of Patent: May 15, 2012

(54) SYSTEM AND METHOD FOR SELLING WELLHEAD PRODUCTION ASSETS

(75) Inventor: William L. Wittsche, Allen, TX (US)

(73) Assignee: EMK3, Ltd. L.L.P., Corpus Christi, TX (US)

( * ) Notice: Subject to any disclaimer, the term of this patent is extended or adjusted under 35 U.S.C. 154(b) by 3968 days.

(21) Appl. No.: 09/843,659

(22) Filed: Apr. 26, 2001

(51) Int. Cl.
*G06Q 30/00* (2012.01)

(52) U.S. Cl. ..... 705/26.3

(58) Field of Classification Search ..... 705/35–39
See application file for complete search history.

(56) References Cited

U.S. PATENT DOCUMENTS

| | | | | |
|---|---|---|---|---|
| 5,794,207 | A * | 8/1998 | Walker et al. | 705/1 |
| 2001/0032175 | A1* | 10/2001 | Holden et al. | 705/37 |
| 2002/0198817 | A1* | 12/2002 | Dhir | 705/37 |

OTHER PUBLICATIONS

Oil & Gas Journal Exchange Launches; Oil and Gas Industry's First Fully Web-Enabled Property Auction Site Now Open for Business. Business Wire. New York. May 9, 2000. p. 1.*

Gallun, Rebecca A; Wright, Charlotte J; Nichols, Linda M; Stevenson, John W. Fundamentals of Oil & Gas Accounting 4th Edition. PennWell Corporation. Jan. 1, 2001. pp. 8-13, 23, 306, 312, 319-320, 331-333, 469-471 and 483-485.*

Miller, Michael. The Complete Idiot's Guide to Online Auctions. Que Press. 1999. pp. 1-49.*

Gallun, Rebecca A; Wright, Charlotte J; Nichols, Linda M; Stevenson, John W. Fundamentals of Oil & Gas Accounting 4th Edition. PennWell Corporation. Jan. 1, 2001. pp. 84, 97 and 305-306.*

* cited by examiner

*Primary Examiner* — Jason M Borlinghaus
(74) *Attorney, Agent, or Firm* — Jackson Walker L.L.P.; Christopher J. Rourk

(57) ABSTRACT

A system for selling wellhead production assets is provided. The system includes a bid request system that displays one or more bidders, such as approved oil refinery operators, and receives one or more bidder selections from the seller. A production posting system connected to the bid request system receives the bidder selections and provides lease data to the bidders selected by the seller, so as to allow the seller to obtain competing bids without alerting the bidders of the other competing bids.

18 Claims, 4 Drawing Sheets

015121.0001

015121.0001

015121.0001

300

015121.0001

400

015121.0001

015121.0001

SYSTEM AND METHOD FOR SELLING WELLHEAD PRODUCTION ASSETS

FIELD OF THE INVENTION

The present invention pertains to the field of oil and gas marketing. More specifically, the invention relates to a system and method for selling wellhead production assets online that allows a seller to control the types of variables that can be modified in a bid and the parties that can bid on the wellhead production asset.

BACKGROUND OF THE INVENTION

Systems for selling assets online are known in the art. Such systems typically provide an auction or a marketplace architecture where sellers can post assets for sale and buyers can bid on those assets. In an auction environment, a finish time will be provided and the buyer offering the highest amount for the item at that time will be awarded the lot. In an online marketplace, additional variables can be specified, such as delivery dates, quantities, and prices, and sellers can post items for sale to the highest bidder.

In the energy market, the online marketplace is used to sell oil and gas at all locations along the production route except the wellhead. Online sales of wellhead production have not been offered in an online environment because such assets can not be integrated into existing online marketplaces for numerous reasons. One reason is that the owners of such production have a business relationship with purchasers of such production. The number of purchasers tends to be very small, such that business alliances may have been forged, personal relationships may have developed, or other ways of identifying potential purchasers of such products may have been implemented. Likewise, the large number of variables in such wellhead production does not allow such oil and gas to be integrated into the existing oil and gas marketplaces.

For example, power companies and industries typically wish to purchase oil and gas in a usable state. For example, gas is typically purchased as delivered through a pipeline. In contrast, the oil and gas produced at the wellhead will require additional refining and processing in order to be usable. The large number of grades, transportation modes for transporting such wellhead oil and gas, particularly oil, and the need for refining and processing significantly complicate the purchase of such wellhead resources, and further prevent their integration into existing energy resource marketplaces.

SUMMARY OF THE INVENTION

In accordance with the present invention, a system and method for selling wellhead production assets online is provided that overcomes known problems with existing systems and methods for selling wellhead production.

In particular, a system and method for selling wellhead production assets online are provided that allow the seller to control the company posting, specify the grade of crude, trade crude at a first location for crude at another location, and select from competing bids based upon factors other than price.

In accordance with an exemplary embodiment of the present invention, a system for selling wellhead production assets is provided. The system includes a bid request system that displays one or more bidders, such as approved oil refinery operators, and receives one or more bidder selections from the seller. A production posting system connected to the bid request system receives the bidder selections and provides lease data to the bidders selected by the seller, so as to allow the seller to obtain competing bids without alerting the bidders of the other competing bids.

The present invention provides many important technical advantages. One important technical advantage of the present invention is a system and method for selling wellhead production assets that allows the sales to be conducted online. Online sales of such assets have not been provided because they do not fit the profile of goods that can be sold online, such as by having a uniform quality (being "fungible"). Likewise, such assets are typically sold to parties that the seller has an established relationship with, such that locating other potential buyers would be difficult and might alienate existing business partners. The present invention eliminates these problems by allowing sellers to specify the relevant characteristics, including ranges of characteristics on which an offer can be based, and to identify bidders for the asset that will be directly contacted.

Those skilled in the art will appreciate the advantages and superior features of the invention together with other important aspects thereof on reading the detailed description that follows in conjunction with the drawings.

DETAILED DESCRIPTION OF THE INVENTION

Figure 1:
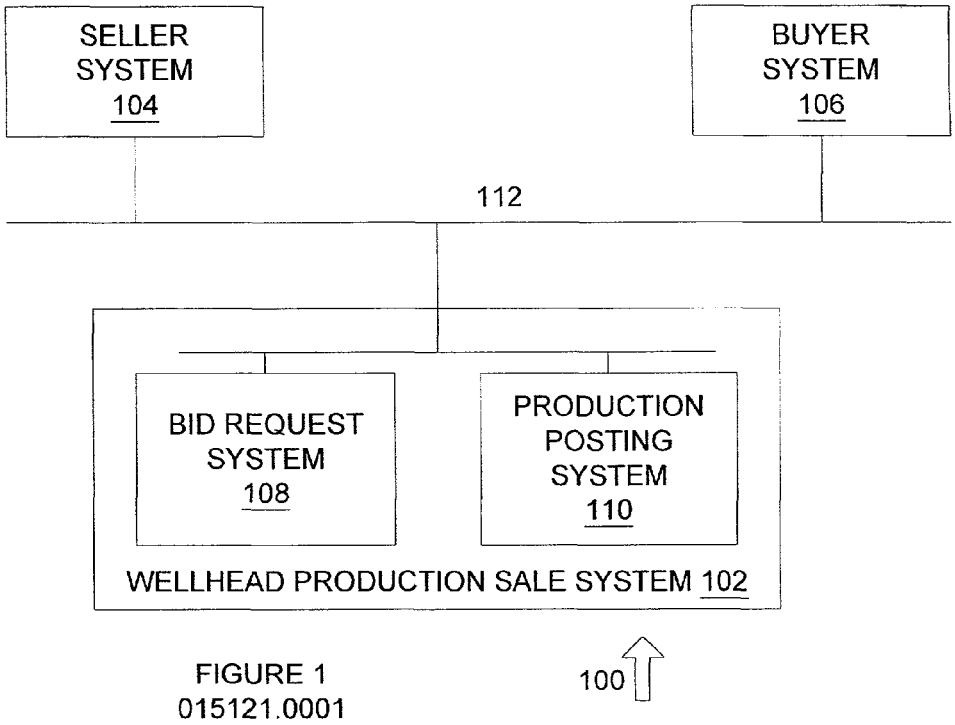
FIG. 1 is a diagram of a system for providing an online marketplace for selling wellhead production assets in accordance with an exemplary embodiment of the present invention.

In the description that follows like parts are marked throughout the specification and drawings with the same reference numerals, respectively. The drawing figures are not necessarily to scale and certain features may be shown in somewhat generalized or schematic form in the interest of clarity and conciseness.

FIG. 1 is a diagram of a system 100 for providing an online marketplace for selling wellhead production assets in accordance with an exemplary embodiment of the present invention. System 100 allows wellhead oil and gas to be sold in a manner that does not require a seller to award a lot to the highest bidder, so that a better price for the lot can be sought without affecting existing business relationships.

System 100 includes wellhead production sale system 102, which can be implemented in hardware, software, or a suitable combination of hardware and software, and which can be one or more software systems operating on a general purpose server platform. As used herein, a software system can include one or more objects, agents, lines of code, threads, subroutines, two or more lines of code or other suitable software structures operating in two or more separate software applications, on two or more different processors, or other suitable software structures. In one exemplary embodiment, a software system can include one or more lines of code or other suitable software structures operating in a general purpose software application, such as an operating system, and one or more lines of code or other suitable software structures operating in a specific purpose software application.

Wellhead production sale system 102 is coupled to seller system 104 and buyer system 106 by a communications medium 112. As used herein, the term "couple," and its cognate terms such as "couples" and "coupled," can include a physical connection (such as through a copper conductor), a virtual connection (such as through one or more randomly assigned data memory locations of a data memory device), a logical connection (such as through one or more logic gates of a semiconducting device), a wireless connection, other suitable connections, or a suitable combination of such connections. In one exemplary embodiment, systems and components can be coupled to other systems and components through intervening systems and components, such as through an operating system of a general purpose server platform. Communications medium 112 can be a local area network, a wide area network, a frame relay, the Internet, the public switched telephone network, a wireless network, other suitable media, or a suitable combination of such media.

Seller system 104 and buyer system 106 can be implemented in hardware, software, or a suitable combination of hardware and software, and can be one or more software systems operating on a general purpose processing platform. In one exemplary embodiment, seller system 104 and buyer system 106 can be Hypertext Markup Language data (HTML) transmitted from wellhead production sale system 102 that is processed by a web browser system operating on either a seller system 104 and buyer system 106, such that the HTML data creates graphical user interfaces (GUIs) that prompt a user to enter predetermined data, and that return displays of related data in response to the data entered by the user.

Seller system 104 allows a wellhead production asset owner to place wellhead for sale to one or more selected buyers. In one exemplary embodiment, a seller can enter bidder selection data, lease description data, and other suitable data, such that one or more predetermined bidders will be provided with the lease description data and invited to bid on the wellhead production assets.

Wellhead production sale system 102 includes bid request system 108 and production posting system 110, each of which can be implemented in hardware, software, or a suitable combination of hardware and software, and which can be one or more software systems operating on a general purpose server platform. Production posting system 110 allows a seller through seller system 104 to place wellhead production assets for sale. In one exemplary embodiment, production posting system 110 generates HTML data that is transmitted to seller system 104, which then prompts the entity controlling seller system 104 to enter lease description data. The lease description data can include location data, estimated output data, mineral data (such as sulfur content, specific gravity, gaseous components, or other suitable data), whether the production would be traded, contract data, and whether the lease is to be packaged with one or more other leases. Production posting system 110 allows a seller to specify the production assets being offered for sale, including which data fields the seller will allow the buyer to alter so as to make a bid for the production assets.

Bid request system 108 is coupled to production posting system 110 and seller system 104 and buyer system 106. Bid request system 108 receives the lease data from production posting system 110 and further receives bidder selection data from seller system 104. Bid request system 108 includes a listing of available purchasers, such as the major oil refining or natural gas companies. Bid request system 108 then interfaces with the buyer system 106 of each selected bidder to present the lease data and to request a bid on the lease data. In this exemplary embodiment, the bid data transmitted through bid request system 108 can be transmitted privately, such that each entity controlling a buyer system 106 is not aware of whether other buyers have received the bids. Likewise, bid request system 108 can allow an entity controlling buyer system 106 to view some or all of the lease data, such as by allowing the lease data to be "publicly" listed, and to request permission to bid on the wellhead production assets. Bid request system 108 can then receive confirmation from seller system 104 to transmit the lease data to the requesting buyer system 106. Likewise, a buyer system 106 that is not presently listed on bid request system 108 can request such a listing, such as by providing buyer background data (including the location, years in operation, lines of credit, existing customer data, and other suitable data), such that an entity controlling wellhead production sale system 102 can determine whether the buyer system 106 requesting access to bid request system 108 should be allowed to participate, poses an unacceptable risk, or should be classified in other suitable manners.

In operation, system 100 allows a seller that owns wellhead production assets to place those assets for sale, such that the seller can approach existing business partners for the sale of the assets and can also determine what interest or price can be obtained from other parties. System 100 thus allows the seller to specify all necessary information to allow one or more buyers to bid on wellhead production assets, but does not require the seller to award the production to the lowest bidder. Likewise, system 100 allows buyers to bid based on nonprice components, such as based on a posting index that they will agree to be bound by, by trading for crude oil, refined oil, natural gas, or other suitable materials at a suitable location, and to accept or reject individual leases as part of packages of leases. System 100 thus allows wellhead production owners to determine whether they are obtaining the best price for their wellhead production, and likewise allows buyers to locate other potential resources that may be better situated geographically, have better mineral parameters, or other suitable parameters.

Figure 2:
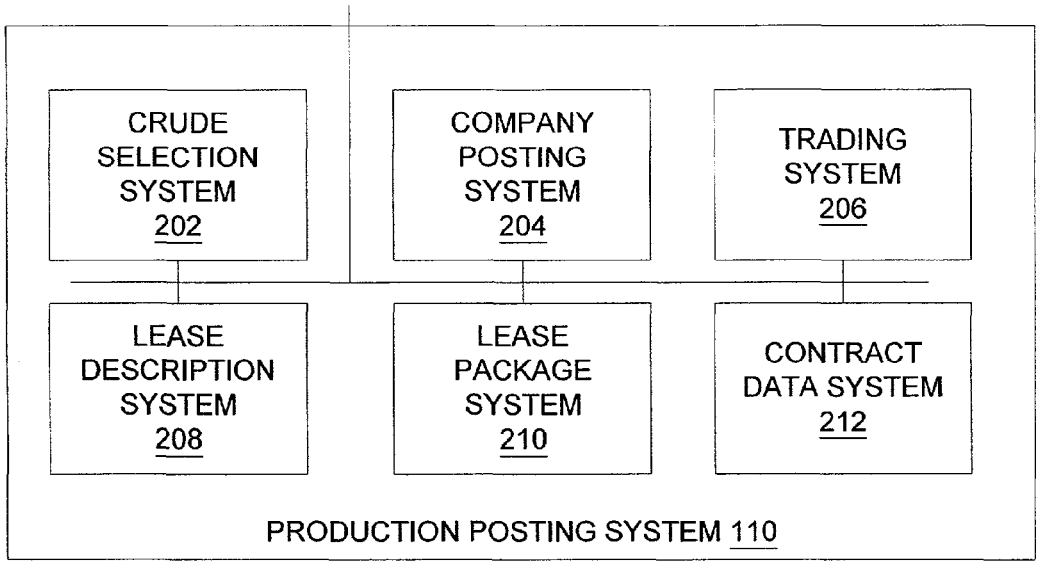
FIG. 2 is a diagram of a system for posting wellhead production assets for sale in accordance with an exemplary embodiment of the present invention.

FIG. 2 is a diagram of a system 200 for posting wellhead production assets for sale in accordance with an exemplary embodiment of the present invention. System 200 allows wellhead production assets to be posted for sale to one or more potential buyers and allows the seller to specify acceptable fields and values that can be modified by potential buyers for the purchase of the assets.

System 200 includes production posting system 110 and crude selection system 202, company posting system 204, trading system 206, lease description system 208, lease package system 210, and contract data system 212, each of which can be implemented in hardware, software, or a suitable combination of hardware and software, and which can be one or more software systems operating on a general purpose server platform. Crude selection system 202 allows the seller to select from a list of available crude oil classifications so as to particularly identify the type of wellhead production asset being offered for sale (when the wellhead production asset does not include natural gas), and to allow the asset to be efficiently searched. Crude selection system 202 can also allow a seller to enter a description of the crude oil grade, but such seller-entered descriptions may not be consistent from seller to seller. In this configuration, a buyer searching for a particular grade of crude may not be able to find all available assets being offered for sale, such as because of a difference in spelling, word arrangement, or other differences. Thus, providing a list of available classes can help to eliminate such inconsistencies. Likewise, crude selection system 202 can interface with lease description system 208 to confirm that the type of crude selected is in fact available in the physical location of the lease as provided in lease description system 208.

Company posting system 204 allows the seller to select one or more company posting indices by which the wellhead production asset is to be priced. There are a large number of company posting indices that are used by refineries to price wellhead production assets, such as the Amoco, Coastal, Diamond Shamrock, FOTT, Equiva, Exxon, Koch, Scurlock, Sun, and other suitable company posting indices. Company posting system 204 allows the seller to specify one or more such company posting indices that the seller will allow the buyer to base an offer on. In one exemplary embodiment, the seller can select a preferred company posting index, but can also enable the buyer to select one or more other company posting indices as part of the buyer's bid. Company posting system 204 also allows the seller to select other criteria by which the asset will be priced, such as price basis, cash or trade, whether a (+) bonus or (−) transportation/G&H will be accepted, if trade then whether a delivery back differential in grade (such as +/− from West Texas Intermediate) will be accepted, and other suitable data.

Trading system 206 allows the seller to specify one or more locations at which the seller will accept crude oil, refined oil, natural gas, or other suitable materials in trade for the wellhead production asset. In one exemplary embodiment, the seller can select to trade wellhead production assets for Empire, St. James, TEPCO-Midland sweet, TEPCO-Midland sour, or TEPCO Cushing crude oil, such that the transaction can be accomplished entirely in trade and does not require any transfer or funds. Other suitable trade quantities and locations of materials can be offered, such as a combination of trade and purchase.

Lease description system 208 allows the seller to identify a particular lease by physical parameters. In one exemplary embodiment, lease description system 208 can allow a seller to provide a lease name, a field name (such as an oil field or other geographical field), a county and state, a latitude and longitude, directions to the lease, an estimated sulfur and specific gravity of the oil produced by the lease, an estimated volume of oil production per day, the type of transportation available from the lease, a tank number or strapping data, disbursement instrument data, a gas pipeline name, a gas pipeline meter number, whether the sale is interstate or intrastate (such as for natural gas), the physical proximity to another pipeline, and to identify which party shall pay severance tax. Lease description system 208 thus provides standardized data fields that allow buyers to readily locate available leases based upon the physical parameters of the lease that may be of interest to the buyer.

Lease package system 210 allows the seller to assemble two or more leases into a lease package, such that all leases must be purchased as part of a package. A price premium or other suitable data can also be provided, so as to allow a buyer to separate a lease from the package for a higher price. Lease package system 210 can also allow a buyer to propose a package, such as by bundling two or more lease assets.

Contract data system 212 allows the buyer to provide contract data, such as contract length, start date, the party that will specify the terms, instructions, the buyer company name, contact name, phone number, accounting name, or operations name. Contract data system 212 can also receive seller contract data from a bid request system 108, such as the seller name, contact name and phone number, accounting name and phone number, and operations name and phone number. Contract data system 212 can also receive other general information from the buyer and seller, such as the dispatcher name, phone number, and pager number for the buyer and the gauger name, phone number, and pager number from the seller.

In operation, system 200 allows a seller of wellhead production assets to specify the assets being sold and the pricing variables that will be allowed and considered from a buyer. System 200 thus allows sellers to control all aspects of the wellhead production asset sale, including the allowable variables that can be modified by a bidder, the grade of the asset at the wellhead, whether the wellhead production asset can be traded, or other suitable data. System 200 thus provides the flexibility and control required by wellhead production asset owners to place such assets for sale.

Figure 3:
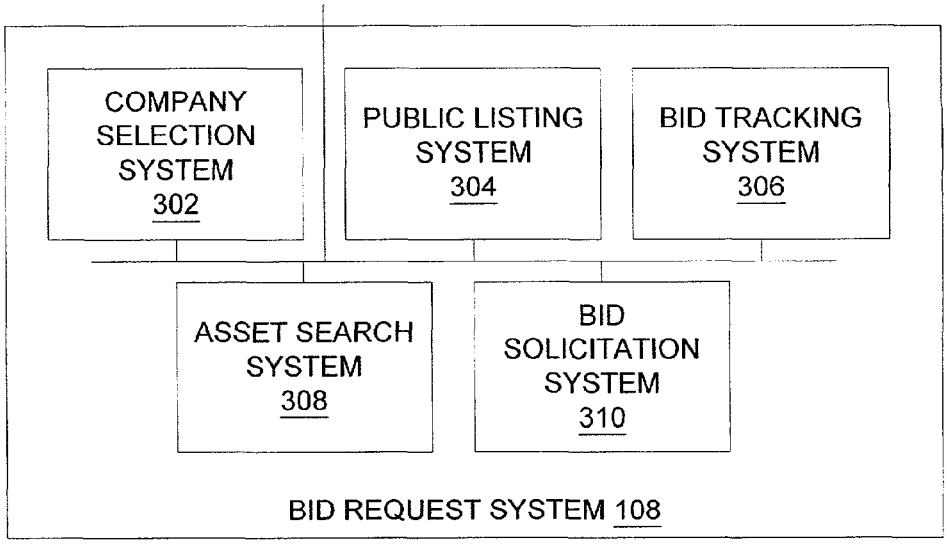
FIG. 3 is a diagram of a system for providing bid request data in accordance with an exemplary embodiment of the present invention.

FIG. 3 is a diagram of a system 300 for providing bid request data in accordance with an exemplary embodiment of the present invention. System 300 includes bid request system 108 and company selection system 302, public listing system 304, bid tracking system 306, asset search system 308, and bid solicitation system 310, each of which can be implemented in hardware, software, or a suitable combination of hardware and software, and which can be one or more software systems operating on a general purpose server platform.

Company selection system 302 allows a seller to select the companies that a bid will be requested from. In one exemplary embodiment, company selection system 302 provides a seller with a list of major oil refinery operators or natural gas companies, and allows the seller to select one or more of these oil refinery operators or natural gas companies for presentation of the lease bid data. In another exemplary embodiment, company selection system 302 can allow a seller to enter a proposed company, which can then be reviewed by the entity controlling bid request system 108 to determine whether the company meets the criteria for listing with company selection system 302. Company selection system 302 can also allow sellers to restrict access to the identification of companies that have been selected to bid on the wellhead production asset, such as where a seller wishes to receive bids from one or more companies but does want existing business partners to know that they are doing so.

Public listing system 304 allows a seller to place lease data for view by nonselected bidders, such as companies having a listing on company selection system 302, any other companies that may request access to system 300, or other suitable companies. In one exemplary embodiment, the seller can adjust data fields for listing through public listing system 304 so that they are different from the data fields presented to solicited bidders, such as for the price requested, the lease package data, or other suitable data. In this manner, the seller can accept better prices from solicited bidders than the general public, but can still determine whether a higher price for the wellhead production asset might be obtained.

Bid tracking system 306 allows sellers and buyers to receive bid status data on pending sales of wellhead production leases. In one exemplary embodiment, bid tracking system 306 can provide a list to each seller or buyer of leases that the party has placed for sale or bid on, respectively. Bid tracking system 306 can also provide data on the final sales price of a lease, the parties that obtained the lease, or other suitable data.

Asset search system 308 allows a buyer to search through available wellhead production asset listings, such as publicly listed assets, interstate or intrastate natural gas listings, listings on or having a predetermined proximity to a certain pipeline, assets for which that buyer has been identified as a bidder, or other suitable assets. Asset search system 308 can also allow a buyer to search through completed sales, to access blind listing data to determine prices being obtained in other transactions or similar wellhead production assets, or can provide other suitable data.

Bid solicitation system 310 allows a bidder that has not received a request for bidding to submit a solicitation to be provided with the request. In one exemplary embodiment, a potential bidder can access data through public listing system 304 and be transferred to bid solicitation system 310 to provide additional data, such as data identifying the potential bidder, bidder registration data when the bidder is not presently registered on system 300, finance data, or other suitable data.

In operation, system 300 allows a seller to identify bidders for which bids will be solicited for wellhead production assets, and allows bidders to locate such assets and request bidder status if they have not been given such status and the seller has publicly listed the wellhead production asset. System 300 thus provides the flexibility and control required by wellhead production asset owners to place such assets for sale.

Figure 4:
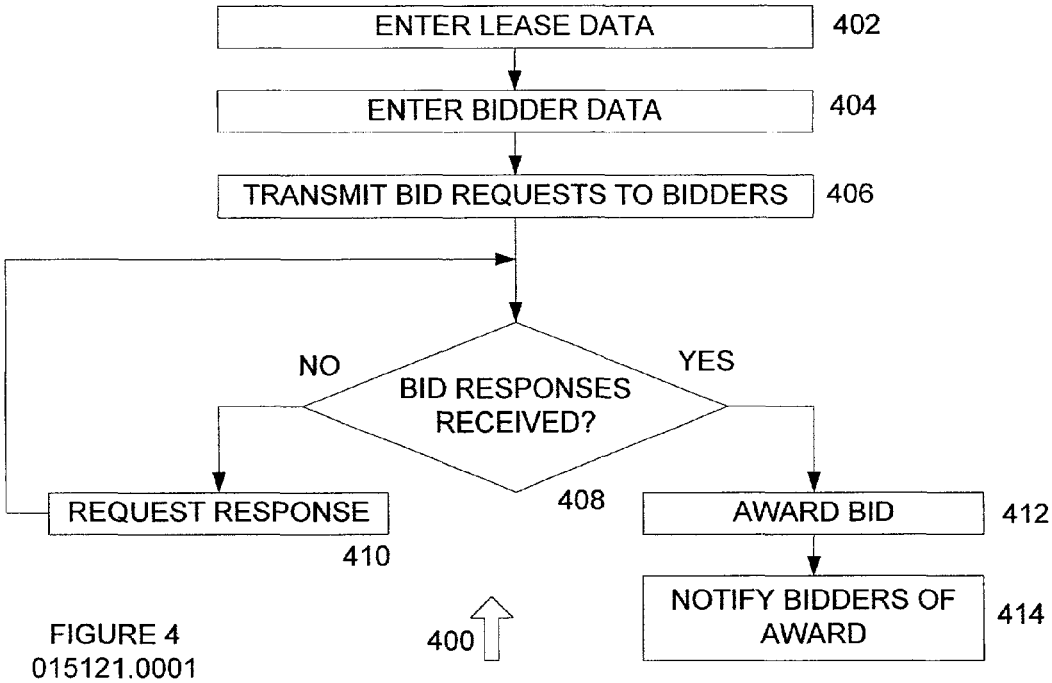
FIG. 4 is a diagram of a method for selling wellhead production assets in accordance with an exemplary embodiment of the present invention.

FIG. 4 is a diagram of a method 400 for selling wellhead production assets in accordance with an exemplary embodiment of the present invention. Method 400 allows wellhead production assets to be sold online.

Method 400 begins at 402 where lease data is entered. Lease data can include physical lease location data, such as latitude, longitude, county, state, or directions, lease identification data such as a lease name, an oil field, a gas field, or other resource field associated with the lease, the estimated sulfur content and specific gravity of the oil produced by the lease, an estimated volumes, volume per day production from the lease, company posting data for identifying company postings that on which prices will be accepted as a basis, crude type data identifying the crude type produced by the well, natural gas content, a pipeline name and meter number, whether the gas is for interstate or intrastate sales, price basis data, cash bonus type data, bonus or transportation/G&H data, trade and delivery back data, or other suitable data. The method then proceeds to 404.

At 404, bidder data is entered. The bidder data can include the identification of one or more parties from which the bid data is to be solicited and accepted, and can include an indication that the lot should be publicly listed so that any qualified or interested bidders can request permission to bid. The method then proceeds to 406.

At 406, the bid requests are transmitted to the bidders. In one exemplary embodiment, the bid request can include bid or lease data that has been tailored to each bidder, blind bid data, such that each bidder is not aware of the other bidders that have been asked to provide bid responses, and other suitable data. The method then proceeds to 408.

At 408, is determined whether all bid responses have been received. If all bid responses have not been received, the method then proceeds to 410 where a response is requested from any nonresponding bidders. Likewise, if it is determined that 408 that bid responses have been received, the method then proceeds to 412.

At 412, the bid is awarded to one of the bidders. Likewise, if none of the bidders have provided an acceptable bid, the seller may determine not to sell the wellhead production asset, to offer the wellhead production asset for sale again, or to take other suitable actions. The method then proceeds to 414.

At 414, the bidders are notified of the award. In one exemplary embodiment, only the winning bidder can be notified that they have won. Likewise, the losing bidders can be notified that they have lost or of other suitable data.

In operation, method 400 allows a seller to offer wellhead production assets for sale to one or more bidders. Method 400 allows the seller to select which bidders will be allowed to provide a bid, and allows the seller to elect to sell wellhead production assets to the bidder that does not offer the best price, such as to maintain business relationships, determine the potential value of the production asset, or for other suitable purposes.

Figure 5:
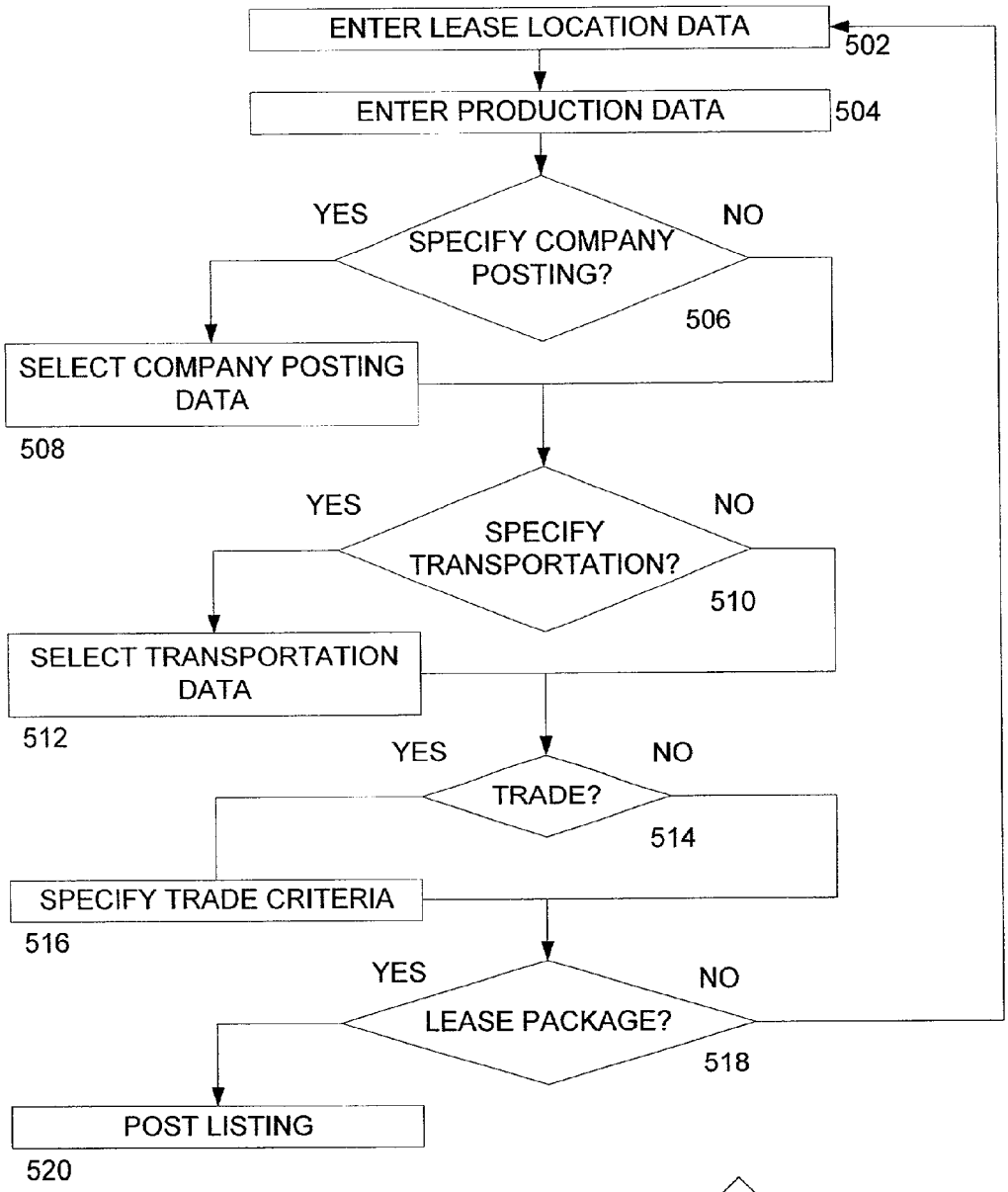
FIG. 5 is a flow chart of a method for allowing a seller to specify bidding variables in accordance with an exemplary embodiment of the present invention.

FIG. 5 is a flow chart of a method 500 for allowing a seller to specify bidding variables in accordance with an exemplary embodiment of the present invention. Method 500 begins at 502 where lease location data is entered. The lease location data can include physical data, such as latitude and longitude, county and state, or other suitable physical location data. The method then proceeds to 504.

At 504 lease production data is entered. Lease production data can include estimated sulfur and specific gravity, volume per day in barrels, cubic feet, or other suitable units of measure, crude type, or other suitable data. The method then proceeds to 506.

At 506, it is determined whether company posting index data is to be specified. If company posting index data is not specified, the method proceeds to 510. Otherwise, the method proceeds to 508 where company posting data is selected. The company posting index data can include one or more refinery identifiers where such refineries specify daily prices for classes of crude, a price basis identifier (such as "cash" or "trade"), bonus type data if the price basis is "cash," whether the bonus is given as an additional amount or subtracted from transportation/G&H, a delivery back differential amount if the price basis is "trade," and other suitable data. The method then proceeds to 510.

At 510 it is determined whether the transportation type is to be specified. If the transportation type is not specified, the method then proceeds to 514. Otherwise, the method proceeds to 512 where the transportation data is selected. In one exemplary embodiment, the transportation can be provided based upon available pipelines, trucklines, shipping lines, or other suitable data. For example, a meter number or the proximity to other pipelines can be provided for natural gas. If it is determined that 510 transportation is to be specified, the method proceeds to 512 where the transportation data is selected. The method then proceeds to 514.

At 514 it is determined whether the seller wishes to accept crude oil, refined product, natural gas, or other suitable materials in trade for the wellhead production, such as if a "trade" price basis has been selected. If the seller does not wish to receive materials in trade, then the method proceeds to 518. Otherwise, the method proceeds to 516 where the trade criteria are specified. In one exemplary embodiment, the seller can elect to trade for various classes of crude oil, refined oil, natural gas, or other suitable materials, the location at which the traded materials will be accepted, a combination of cash and crude oil, or other suitable trade criteria. The method then proceeds to 518.

At 518 it is determined whether the lease is being included in a lease package. If it is determined that the lease is to be included in the lease package, the lease package information is added and the method returns to 502. Otherwise, the method proceeds to 520 where the listing is posted, such as by posting for public bidding, by transmitting to request a bidder, or by other suitable procedures.

In operation, method 500 allows lease production variables to be specified to allow a seller to control the types of bidding, the company posting index data that can be used, or other suitable features. Method 500 thus allows a seller to define the available parameters for bidding on wellhead production assets.

Figure 6:
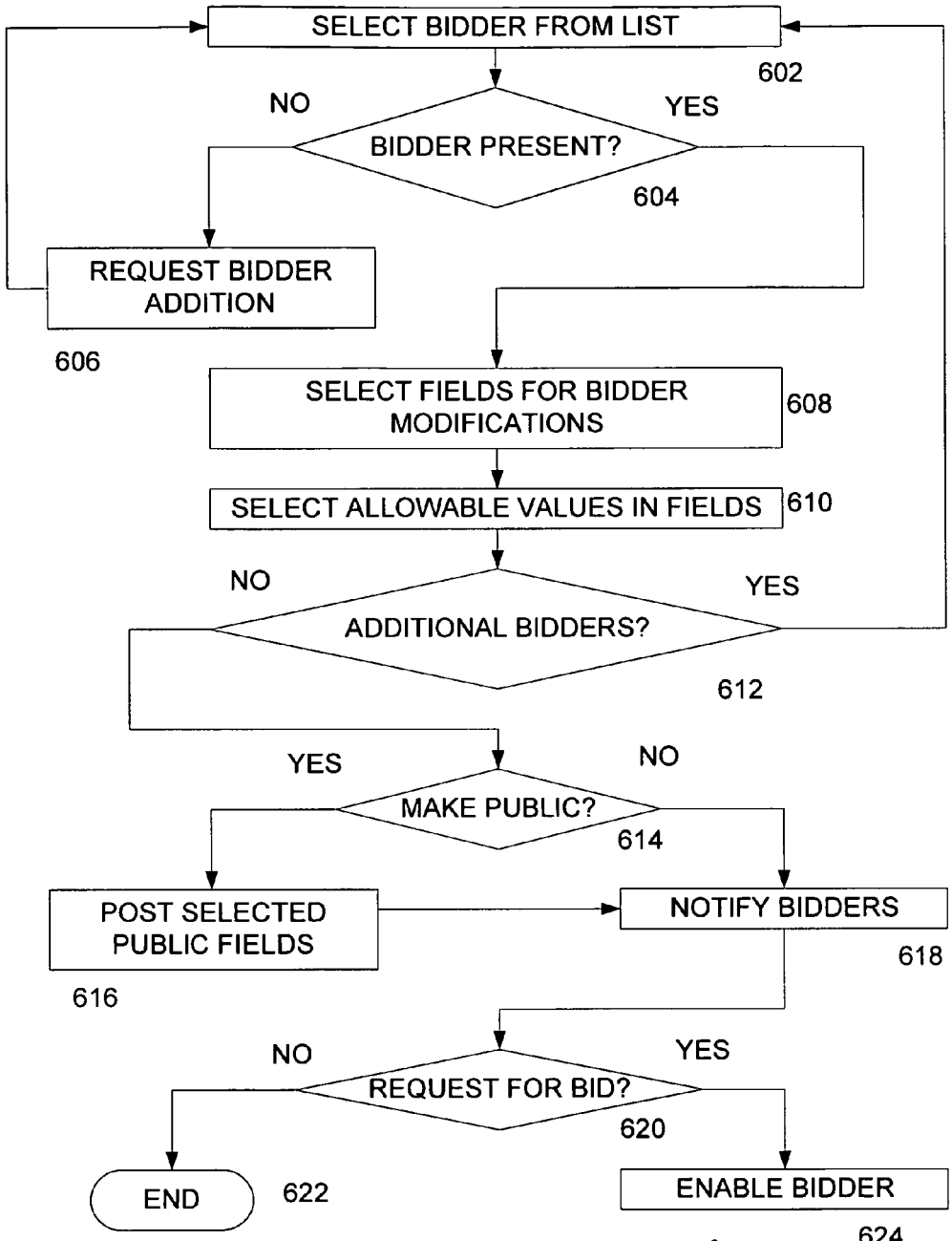
FIG. 6 is a flow chart of a method for selecting bidder data in accordance with an exemplary embodiment of the present invention.

FIG. 6 is a flow chart of a method 600 for selecting bidder data in accordance with an exemplary embodiment of the present invention. Method 600 begins at 602 where the bidder is selected from a list of authorized bidders. The list can include predetermined refineries, natural gas companies, or other parties that are in a position to purchase wellhead production. The method then proceeds to 604.

At 604 it is determined whether a desired bidder is available on the list. If the bidder is not present, the method proceeds to 606 where a request is made to add the bidder to the bidder list. In one exemplary embodiment, such bidders can be added on a seller by seller basis, so as to allow the bidder to access that seller's wellhead production asset sales but not to access other seller's wellhead production asset sales. The method then returns to 602. If it is determined at 604 that all bidders are present, then the method proceeds to 608.

At 608 fields are selected for bidder modifications. In one exemplary embodiment, a first bidder may be allowed to modify the company posting index or price basis for bid, whereas a second bidder may be given a quote on a "take it or leave it" basis, where the company posting index and price basis are fixed. The fields for bidder modifications can be set for individual bidders or globally at 608. The method then proceeds to 610.

At 610 allowable values for the data fields are selected. In one exemplary embodiment, the seller can select an index data field identifying indexes for which bids will be accepted from a bidder, a range of cash bonuses that will be accepted from a bidder, or other suitable value ranges for the fields. These value ranges can also be set for individual bidders, globally, or in accordance with other suitable procures. The method then proceeds to 612.

At 612 it is determined whether there are additional bidders to be selected. If there are no additional bidders, the method proceeds to 614. Otherwise, then it returns to 602.

At 614 it is determined whether or not to make the bid data public. If it is determined that the bid data should not be public, the method proceeds to 618. Otherwise, the method proceeds to 616 where public field selections are made and the selected fields are posted, such as location data, production data, a restricted set of company posting or price basis data, or other suitable data. The method then proceeds to 618.

At 618 the selected bidders are notified of the request for bidding. The method then proceeds to 620 where it is determined whether a request for bid has been received from a bidder that was not identified. If no request for bid has been received, then the method proceeds to 624 and terminates. Otherwise, the method proceeds to 622 where the bidder is provided with approval to bid, rejected, or provided with other suitable data by the seller.

In operation, method 600 allows a seller to select one or more bidders for bidding on wellhead production assets. Method 600 allows a seller to discreetly obtain bids from other business parties so as to estimate the value of wellhead production assets in a manner that does not require existing business partners to be made aware of the request.

Although exemplary embodiments of the system and method for selling wellhead production assets had been described in detail herein, those skilled in the art will also recognize that various substitutions and modifications can be made to the systems and methods without departing from the scope and spirit of the appended claims.

What is claimed is:

1. A system for selling wellhead production assets comprising:

a bid request system for electronically displaying one or more bidders and electronically receiving one or more bidder selections from an owner of the wellhead production assets;

a production posting system for electronically receiving the bidder selections and transmitting lease data to the selected bidders using electronic data processing equipment; and an asset search system for electronically receiving wellhead location data associated with the lease data and electronically processing the wellhead location data to identify one or more pipelines within a predetermined distance from the wellhead location data and electronically displaying data identifying the one or more pipelines.

2. The system of claim 1 wherein the bid request system further comprises a public listing system providing the lease data to one or more public users and receiving bid request data.

3. The system of claim 1 wherein the bid request system further comprises a bid tracking system storing bid transmission data and bid response data.

4. The system of claim 2 wherein the bid request system further comprises a bid solicitation system receiving the bid request data and bid authorization data and transmitting the lease data to a corresponding bidder.

5. The system of claim 1 wherein the production posting system presents a plurality of classes of crude oil and receives a user selection of one of the classes of crude oil.

6. The system of claim 1 wherein the production posting system presents a plurality of company posting fields and receives a user selection of one of the company posting fields.

7. The system of claim 1 wherein the production posting system presents a plurality of material fields and receives a user selection of one of the material fields.

8. The system of claim 1 wherein the production posting system receives two or more lease identifier fields and associates the lease identifier fields with a package field.

9. A method for selling wellhead production assets comprising:

electronically receiving lease data encoded in an electronic format, including trade package data that defines two or more leases that must be purchased in a single package and wellhead location data;

electronically processing the lease data to identify one or more pipelines within a predetermined distance from the wellhead location data;

electronically receiving bidder data encoded in an electronic format;

electronically transmitting the lease data to one or more bidders corresponding to the bidder data using electronic data processing equipment;

electronically presenting response data from each bidder after all bidders have provided the response data; and electronically receiving bidder selection data corresponding to one of the bidders.

10. The method of claim 9 wherein receiving lease data further comprises receiving company posting data that defines one or more company postings that will be used to set the price for the wellhead production asset being sold.

11. The method of claim 9 wherein receiving lease data further comprises receiving transportation data that defines one or more modes of transportation that are available for the wellhead production asset being sold.

12. The method of claim 9 wherein receiving lease data further comprises receiving trade data that defines one or more finished products that will be accepted in trade for the wellhead production asset being sold.

13. The method of claim 9 wherein receiving bidder data further comprises receiving bid field data that defines one or more fields that the bidders will be allowed to modify.

14. The method of claim 9 wherein receiving bidder data further comprises:

making the lease data available for viewing by non-selected bidders;

receiving bid query data; and selecting a bidder associated with the bid query data.

15. The method of claim 9 wherein the lease data is oil well lease data.

16. The method of claim 9 wherein the lease data is gas well lease data.

17. The method of claim 9 wherein receiving the bidder data comprises:

receiving a natural gas lease data field from a user;

providing lease data for one or more natural gas leases to the user that include the natural gas lease data; and receiving the bidder data from the user in response to the provided lease data.

18. The method of claim 9 wherein receiving the bidder data comprises:

receiving an oil lease data field from a user;

providing lease data for one or more oil leases to the user that include the oil lease data; and receiving the bidder data from the user in response to the provided lease data.

* * * * *